US009151567B1

(12) United States Patent
Estridge

(10) Patent No.: US 9,151,567 B1
(45) Date of Patent: Oct. 6, 2015

(54) DROP-AWAY ARROW REST ASSEMBLY

(71) Applicant: TruGlo, Inc., Richardson, TX (US)

(72) Inventor: John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 188 days.

(21) Appl. No.: 13/833,376

(22) Filed: Mar. 15, 2013

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 124/44.5, 24.1, 86, 88
See application file for complete search history.

(56) References Cited

U.S. PATENT DOCUMENTS

| | | | | | |
|---|---|---|---|---|---|
| 3,504,659 | A | | 4/1970 | Babington | |
| 4,071,014 | A | | 1/1978 | Trotter | |
| 4,421,092 | A | * | 12/1983 | Christian | 124/44.5 |
| 4,803,971 | A | * | 2/1989 | Fletcher | 124/44.5 |
| 5,025,773 | A | * | 6/1991 | Hintze et al. | 124/44.5 |
| 5,031,601 | A | * | 7/1991 | Gunter | 124/44.5 |
| 5,253,633 | A | * | 10/1993 | Sisko | 124/44.5 |
| 5,285,764 | A | * | 2/1994 | Mertens | 124/44.5 |
| 5,365,912 | A | * | 11/1994 | Pittman | 124/44.5 |
| 5,383,441 | A | * | 1/1995 | Lightcap, Jr. | 124/44.5 |
| 5,490,492 | A | * | 2/1996 | Savage | 124/44.5 |
| 5,526,800 | A | * | 6/1996 | Christian | 124/44.5 |
| 5,632,263 | A | | 5/1997 | Sartain | |
| 5,896,849 | A | * | 4/1999 | Branthwaite et al. | 124/44.5 |
| 6,044,832 | A | * | 4/2000 | Piersons, Jr. | 124/44.5 |
| 6,202,635 | B1 | * | 3/2001 | Evans | 124/44.5 |
| RE38,096 | E | * | 4/2003 | Branthwaite et al. | 124/44.5 |
| 6,561,175 | B1 | * | 5/2003 | Tidmore | 124/44.5 |
| 6,634,349 | B2 | * | 10/2003 | Mizek et al. | 124/44.5 |
| 6,688,297 | B1 | * | 2/2004 | Clague | 124/44.5 |
| 6,725,851 | B1 | * | 4/2004 | Graf | 124/44.5 |
| 6,739,321 | B1 | * | 5/2004 | Puchlerz | 124/44.5 |
| 6,772,747 | B1 | * | 8/2004 | Vastag | 124/44.5 |
| 6,782,881 | B2 | * | 8/2004 | Mizek et al. | 124/44.5 |
| 6,789,535 | B1 | * | 9/2004 | McIntyre | 124/44.5 |
| 6,789,536 | B1 | * | 9/2004 | Summers | 124/44.5 |
| 6,792,932 | B2 | | 9/2004 | Musacchia, Jr. | |
| 6,913,008 | B2 | * | 7/2005 | Simo et al. | 124/44.5 |
| 6,994,080 | B1 | * | 2/2006 | Yoder | 124/44.5 |

(Continued)

*Primary Examiner* — Melba Bumgarner
*Assistant Examiner* — Alexander Niconovich
(74) *Attorney, Agent, or Firm* — Alvin R. Wirthlin

(57) ABSTRACT

An arrow rest adaptable between right-hand and left-hand configurations includes a support body having a floor portion, a first arm portion and a second arm portion extending from the floor portion. The first at second arm portions have first and second upper connection ends, respectively. An arrow support portion is rotatably connected to the support body between the first and second arm portions for supporting the shaft of an arrow. A capture arm has a lower connection end for connection to one of the first and second upper connection ends. The capture arm is either connected to the first arm portion when the arrow rest is in a right-hand configuration or connected to the second arm portion when the arrow rest is in a left-hand configuration. A torsion hinge assembly includes a shaft rotatably connected to the support body and fixedly connected to the arrow support portion. First and second pulleys are fixed at opposite ends of the shaft. The first pulley is connected to an activation cable when the arrow rest is in a right-hand configuration. Alternatively, the second pulley is connected to the activation cable when the arrow rest is in a left-hand configuration.

20 Claims, 6 Drawing Sheets

(56) References Cited

U.S. PATENT DOCUMENTS

| | | | | |
|---|---|---|---|---|
| 7,219,662 | B1 * | 5/2007 | Henry | 124/44.5 |
| 7,681,566 | B2 * | 3/2010 | Mertens | 124/44.5 |
| 7,748,371 | B1 * | 7/2010 | Doty | 124/44.5 |
| 7,913,678 | B2 * | 3/2011 | Hudkins | 124/44.5 |
| 7,963,279 | B2 * | 6/2011 | Harwath et al. | 124/44.5 |
| 7,975,680 | B1 * | 7/2011 | Montgomery | 124/44.5 |
| 7,980,237 | B1 * | 7/2011 | Rasor et al. | 124/44.5 |
| 8,544,458 | B1 * | 10/2013 | LoRocco et al. | 124/44.5 |
| 8,875,687 | B1 * | 11/2014 | Huang et al. | 124/44.5 |
| 2004/0134474 | A1 * | 7/2004 | Graf | 124/44.5 |
| 2008/0173290 | A1 * | 7/2008 | Harwath et al. | 124/44.5 |
| 2010/0175675 | A1 * | 7/2010 | Roberts et al. | 124/25.6 |
| 2010/0263651 | A1 * | 10/2010 | Evans | 124/44.5 |
| 2011/0168148 | A1 * | 7/2011 | Mizek | 124/44.5 |
| 2013/0269668 | A1 * | 10/2013 | Hunt | 124/44.5 |
| 2014/0014082 | A1 * | 1/2014 | Hunt | 124/44.5 |

* cited by examiner

DROP-AWAY ARROW REST ASSEMBLY

BACKGROUND OF THE INVENTION

This invention relates generally to accessories for archery bows, and more particularly to an arrow rest that deflects during release of an arrow from an archery bow.

In hunting, 3D archery, and field archery, accuracy is of paramount importance. The presence of the arrow rest plays a very significant role in achieving accuracy in shooting. There are at least four factors in the operation of a compound bow which may be affected by the presence of the arrow rest. First, the trajectory of the arrow can be altered when the fletching of the arrow contacts the rest. Second, because all arrows are sized to bend slightly under the instantaneous load applied to the shaft upon release, the trajectory of the arrow can be altered by its deflection against the rest, especially if the rest is rigid. Third, during release of the arrow, the archer may subject the bow to some inadvertent horizontal or vertical movement that is transferred to the rest and thence to the arrow, thereby causing the trajectory of the arrow to be altered. Fourth, noise generated as the arrow shaft slides across the arrow rest can be sufficient to create undesirable friction and frighten game during hunting.

It would therefore be desirous to provide an arrow rest that overcomes one or more of the above-mentioned factors.

BRIEF SUMMARY OF THE INVENTION

According to one aspect of the invention, an arrow rest for supporting the shaft of an arrow is provided. The arrow rest is adaptable between right-hand and left-hand configurations and includes a support body having a floor portion, a first arm portion and a second arm portion extending from the floor portion. The first at second arm portions have first and second upper connection ends, respectively. An arrow support portion is connected to the support body between the first and second arm portions for supporting the shaft of an arrow. A capture arm has a lower connection end for connection to one of the first and second upper connection ends. The capture arm is connected to the first arm portion when the arrow rest is in a right-hand configuration. The capture arm is alternatively connected to the second arm portion when the arrow rest is in a left-hand configuration.

According to a further aspect of the invention, an arrow rest for supporting the shaft of an arrow is provided. The arrow rest is adaptable between right-hand and left-hand configurations and includes a support body, an arrow support portion connected to the support body for supporting the shaft of an arrow, and a hinge assembly. The hinge assembly includes a shaft extending through the support body and the arrow support portion. The arrow support portion is fixed to the shaft for rotation therewith between an upright position and a lowered position. A first pulley is connected to one end of the shaft for rotation therewith. A second pulley is connected to an opposite end of the shaft for rotation therewith. An actuating cable has a first end connected to one of the first and second pulleys and a second end connectable to a bus cable of an archery bow. The actuating cable is connected to the first pulley when the arrow rest is in a right-hand configuration, and the actuating cable is connected to the second pulley when the arrow rest is in a left-hand configuration.

According to yet another aspect of the invention, an arrow rest assembly for supporting the shaft of an arrow is provided. The arrow rest is adaptable between right-hand and left-hand configurations and includes a mounting bracket adapted for connection to the riser of an archery bow, an adjustment block connected to the mounting bracket, the adjustment block being adjustable in elevation with respect to the mounting bracket, a connector arm connected to the adjustment block, the connector arm being adjustable in a windage direction with respect to the adjustment block, the connector arm being reversibly connectable to the adjustment block for adapting to the right-hand and left-hand configurations, a support body having a floor portion, a first arm portion and a second arm portion extending from the floor portion, the first and second arm portions having first and second connection ends, respectively, each connection end including spaced first and second fingers, a capture arm having a lower connection end for connection to one of the first and second connection ends between the first and second fingers, the capture arm being connected to the first arm portion when the arrow rest is in the right-hand configuration, and the capture arm being connected to the second arm portion when the arrow rest is in the left-hand configuration, the first arm portion, second arm portion, and capture arm being curved to thereby form a generally ring-shaped support body with a gap formed between one of the first and second arm portions and the capture arm for receiving the shaft of an arrow, an arrow support portion rotatably connected to the support body between the first and second arm portions for supporting the shaft of an arrow between an upright position and a lowered position, a hinge assembly including a shaft extending through the support body and the arrow support portion, the arrow support portion being fixed to the shaft for rotation therewith between the upright position and the lowered position, a first pulley connected to one end of the shaft for rotation therewith, and a second pulley connected to an opposite end of the shaft for rotation therewith, and an actuating cable having a first end connected to one of the first and second pulleys and a second end connectable to a bus cable of an archery bow. The actuating cable is connected to the first pulley when the arrow rest is in a right-hand configuration, and the actuating cable is connected to the second pulley when the arrow rest is in a left-hand configuration. A torsion spring is connected to the shaft and the support body to thereby bias the arrow support portion toward the lowered position.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
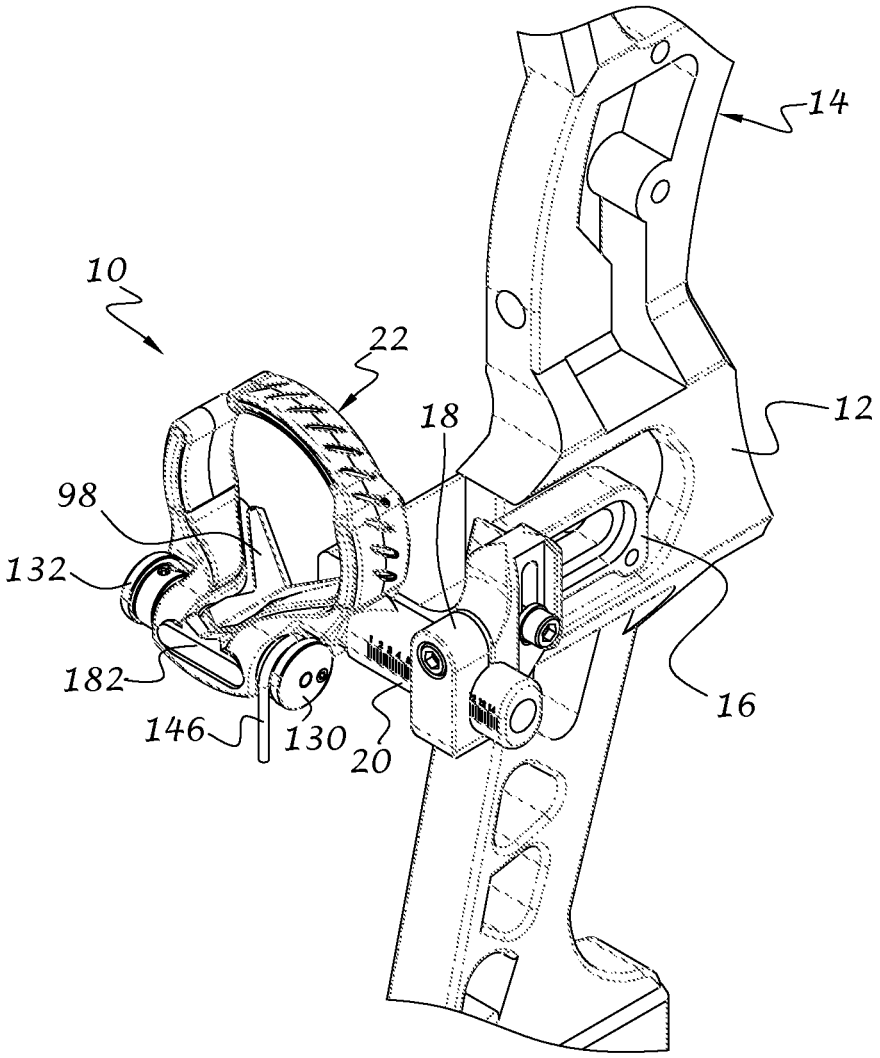
FIG. 1 is a rear isometric view of an arrow rest assembly in accordance with the present invention connected to the riser of an archery bow.

Referring now to FIG. 1 of the drawings, a drop-away arrow rest assembly 10 in accordance with the present invention is shown connected to the riser 12 of a compound archery bow 14 (only partially shown). The compound archery bow 14 is for illustration purposes only since the arrow rest assembly 10 of the present invention can be adapted for use with any type of bow including, but not limited to, crossbows, recurve bows, reflex bows, longbows, and so on.

Figure 2:
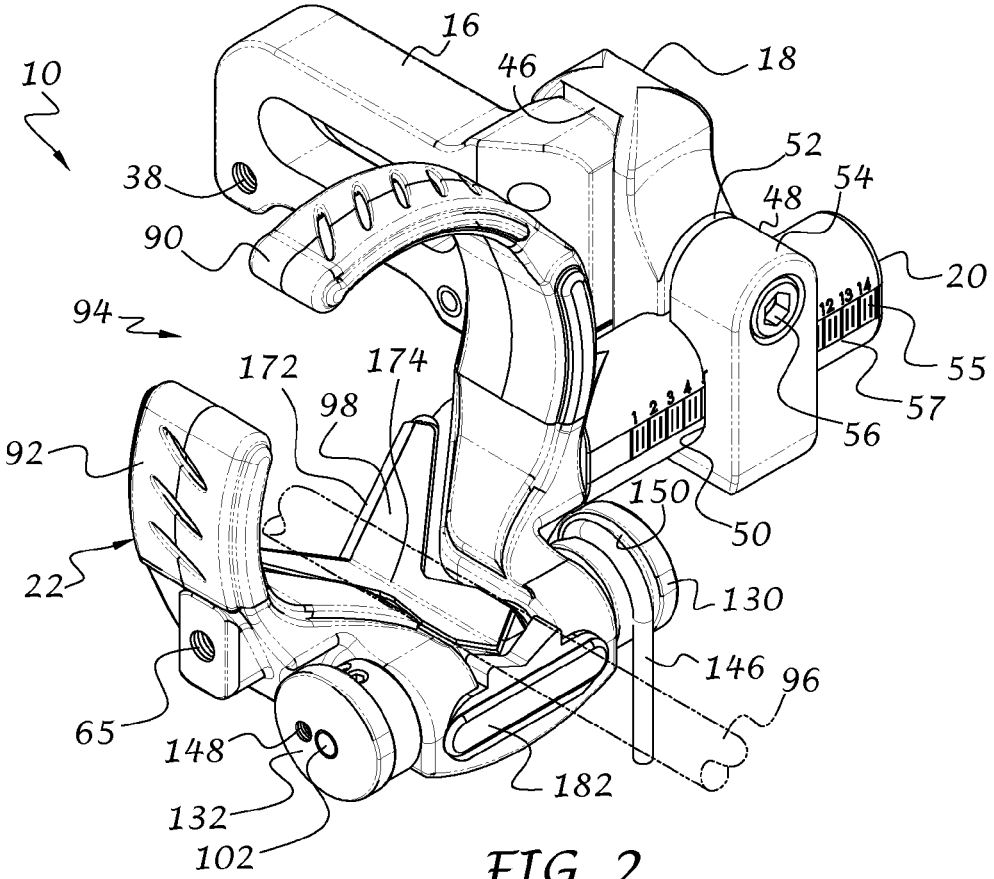
FIG. 2 is a left-side rear isometric view of the resilient arrow rest assembly with an arrow support portion in a lowered position.
Figure 3:
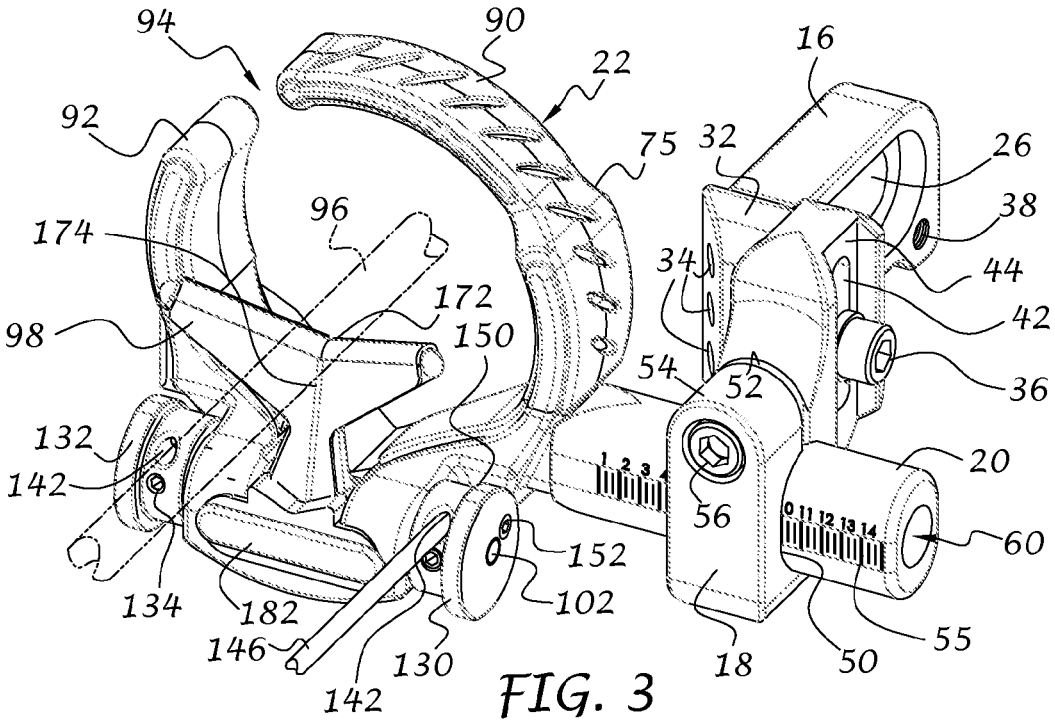
FIG. 3 is a right-side rear isometric view thereof with the arrow support portion in a raised position.

With additional reference to FIGS. 2 and 3, the drop-away arrow rest assembly 10 preferably includes a mounting bracket 16 for connection to the riser 12 (FIG. 1) of a bow or the like, an adjustment block 18 connected to the mounting bracket 16, a connector arm 20 connected to the adjustment block 18, and an arrow rest 22 connected to the connector arm 20.

Figure 4:
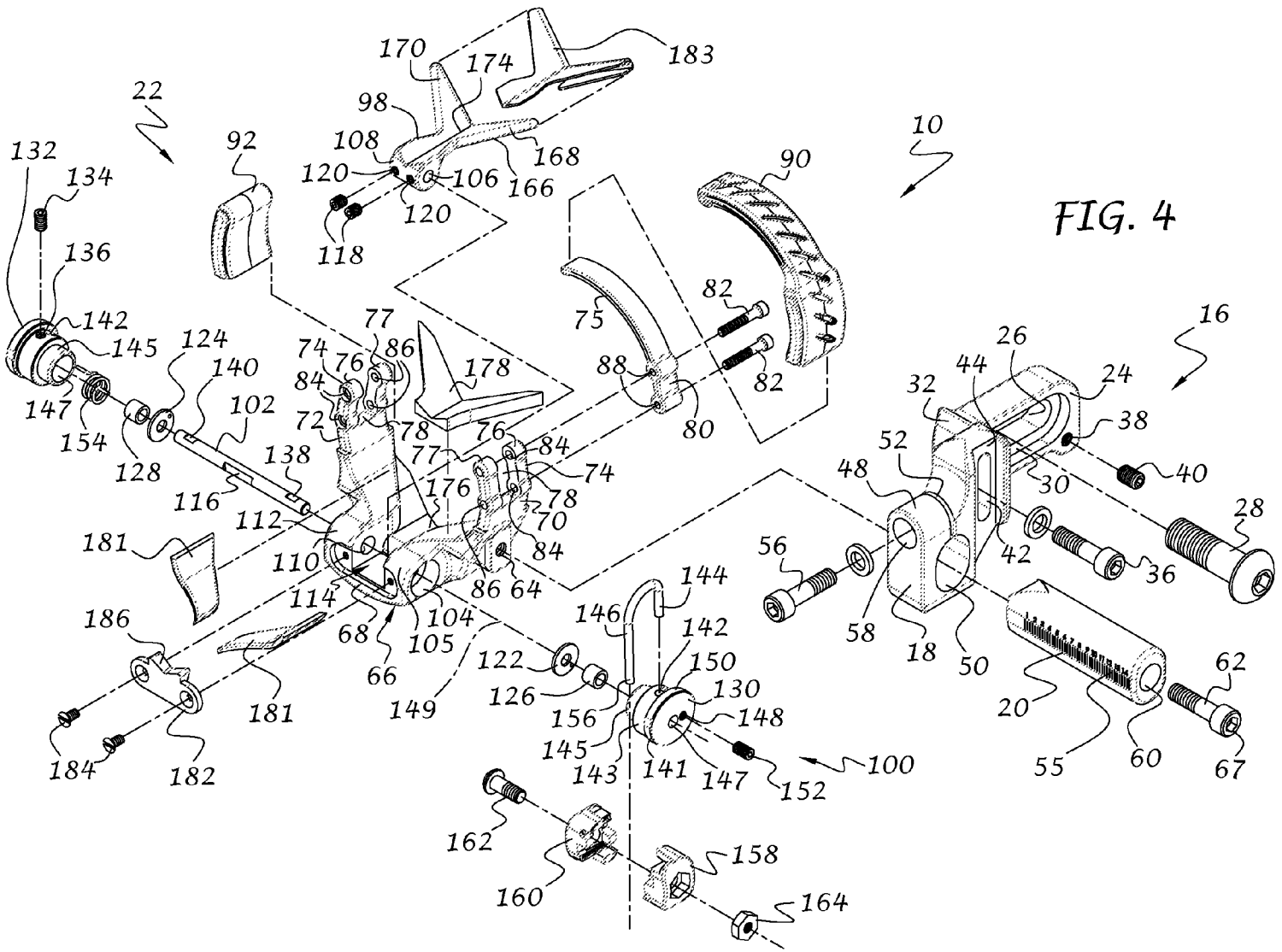
FIG. 4 is a rear isometric exploded view thereof.
Figure 5:
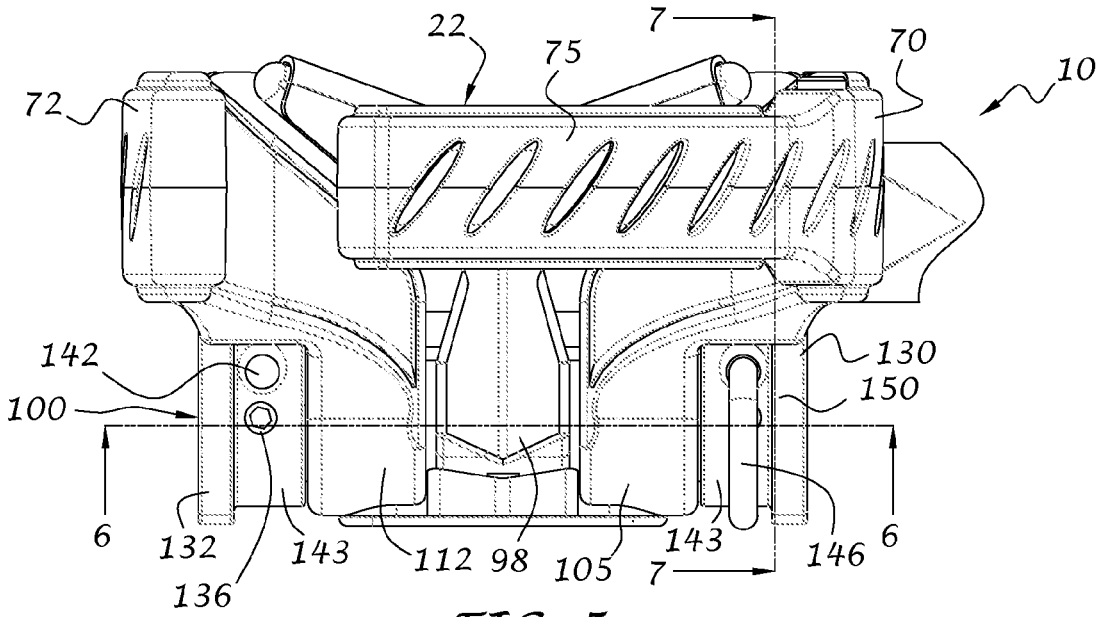
FIG. 5 is a top plan view thereof.

With further reference to FIG. 4, the mounting bracket 16 can be of conventional construction and preferably includes an elongate base plate 24 that, when mounted to a bow or the like, extends in a generally horizontal direction. The base plate 24 preferably includes an elongate slot 26 extending therethrough for receiving a fastener 28 or the like so that the mounting bracket 16 can be attached to the riser 12 (FIG. 1) of a bow 14 in a well-known manner. An elongate recess 30 is formed adjacent to and surrounds the groove so that the fastener head can be located within the mounting bracket 16. A connecting portion 32 of the mounting bracket 16 is located rearwardly of the elongate base plate 24 and extends in a transverse direction thereto, or in a generally vertical direction when the mounting bracket 16 is mounted to the bow or the like. Threaded openings 34 (FIG. 7) are formed in the connecting portion 32 for receiving a threaded fastener 36 or the like when connecting the adjustment block 18 thereto. Threaded openings 38 (FIGS. 7 and 8) are also formed in the base plate 24 for receiving a set screw 40 (only one shown). Since the risers of most bows are provided with only a single mounting opening for connecting an arrow rest thereto, one or more of the set screws 40 can be used to press against the riser 12 (FIG. 1) of a bow when the resilient arrow rest assembly 10 is connected thereto so that the arrow rest assembly does not rotate or otherwise move with respect to the riser.

The adjustment block 18 preferably includes an elongate slot 42 that extends in a generally vertical direction and is in alignment with the threaded openings 34. The elongate slot 42 is adapted to receive the threaded fastener 36 so that the adjustment block 18 can be connected to the mounting bracket 16. The combination of the elongate slot 42 and plurality of threaded openings 34 in the connecting portion 32 ensures that a wide range of elevation adjustment is available to the user, while maintaining relatively low profiles of the mounting bracket 16 and adjustment block 18, thereby reducing the size and material requirements. A scale (not shown) can be located on a forward face of the adjustment block 18 to assist with the elevation adjustment.

Figure 9:
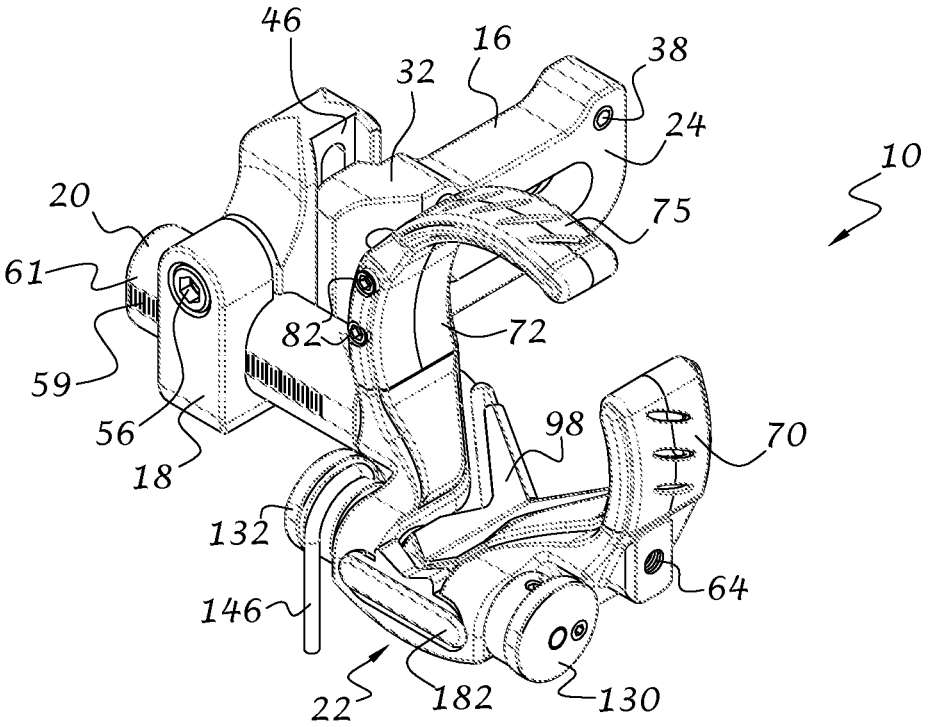
FIG. 9 is right-side rear isometric view of the arrow rest assembly configured for a left-handed archer.
Figure 10:
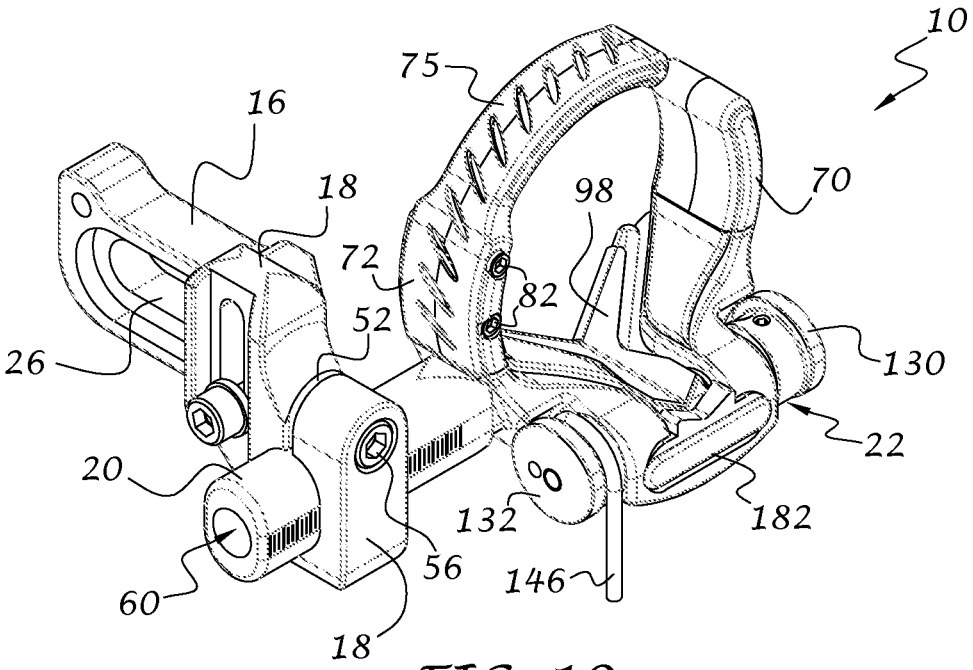
FIG. 10 is a left-side rear isometric view thereof.

As best shown in FIGS. 2 and 3, the adjustment block 18 preferably includes a left side groove 44 and an opposing right side groove 46 that are similar in shape and coincident with the elongate slot 42. The grooves 44 and 46 are also complimentary in shape to the connecting portion 32. In the right-hand set-up as shown, the connecting portion 32 is received in the left side groove 44 so that the arrow rest 22 is positioned on the left side of the riser 12 (FIG. 1). In a left-hand set-up, as shown in FIGS. 9 and 10, the connecting portion 32 is received in the right side groove 46 so that the arrow rest 22 is positioned on the right side of the riser 12 (FIG. 1). In this manner, the arrow rest assembly 10 is quickly and easily converted between right-hand and left-hand use, depending on the preferences of the individual user.

Referring to FIGS. 2-4, the adjustment block 18 also includes a clamping portion 48 for holding the connector arm 20 in an adjusted windage position. The clamping portion 48 preferably includes an opening 50 for receiving the connector arm 20, a slot 52 that extends from an upper edge 54 of the adjustment block to the opening 50, and a threaded fastener 56 that extends through a first transverse opening 58 in the adjustment block on one side of the slot 52, and a second transverse opening (not shown) on the opposite side of the slot 52. The second transverse opening is preferably threaded to accommodate the threaded portion of the fastener 56. In order to clamp the connector arm to the adjustment block 18, the connector arm 20 is inserted into the opening 50 and adjusted until the desired windage position is attained. The fastener 56 is then tightened to thereby close the slot 52, and thus reduce the size of the opening 50, until the connector arm 20 is firmly held in the clamping portion 48. When it is desirous to adjust or remove the connector arm with respect to the adjustment block 18, the fastener 56 is loosened until the connector arm 20 can slide out of the opening 50.

As best shown in FIGS. 2 and 9, a first windage scale 55 is preferably located on a rear face 57 of the connector arm 20 and a second windage scale 59 is preferably located on a front face 61 of the connector arm to facilitate windage adjustment. The provision of opposing scales on the connector arm 20 ensures that one of the scales will be viewed in both the right-hand configuration (FIG. 2) and left-hand configuration (FIG. 9).

Referring to FIGS. 3 and 4, the connector arm 20 is preferably complementary in shape to the opening 50 and includes a central bore 60 that receives a threaded fastener 62. When the arrow rest 22 is connected to the connector arm 20, the fastener 62 extends into a threaded aperture 64 (FIG. 4) of the arrow rest 22 for a right-hand configuration and a threaded aperture 65 (FIG. 2) for a left-hand configuration. A head 67 (FIG. 4) of the fastener 62 preferably abuts an internal step (not shown) formed in the bore 60 so that the connector arm 20 and arrow rest 22 are securely connected together.

When it is desirous to change from a right-hand setup to a left-hand setup, the connector arm 20 can be removed from the opening 50 by moving the arrow rest 22 to the left, as shown in FIG. 3, then re-inserting the connector arm 20 into the opening 50 on the opposite side of the adjustment block 18. For a forward dropping movement of the arrow support portion 98 (described in greater detail below), the arrow rest 22 is removed from the connector arm 20 during the change and is rotated to align the threaded aperture 65 with the fastener 62. However, when it is desirous to have the arrow support portion drop in a rearward direction, the arrow rest 22 can be left on the connector arm 20 with the fastener engaging the threaded aperture 64. Likewise, when in the right-hand configuration, if it is desired to have a rearward dropping arrow support portion, the arrow rest may be turned around so that the threaded aperture 65 engages the fastener 62.

Figure 6:
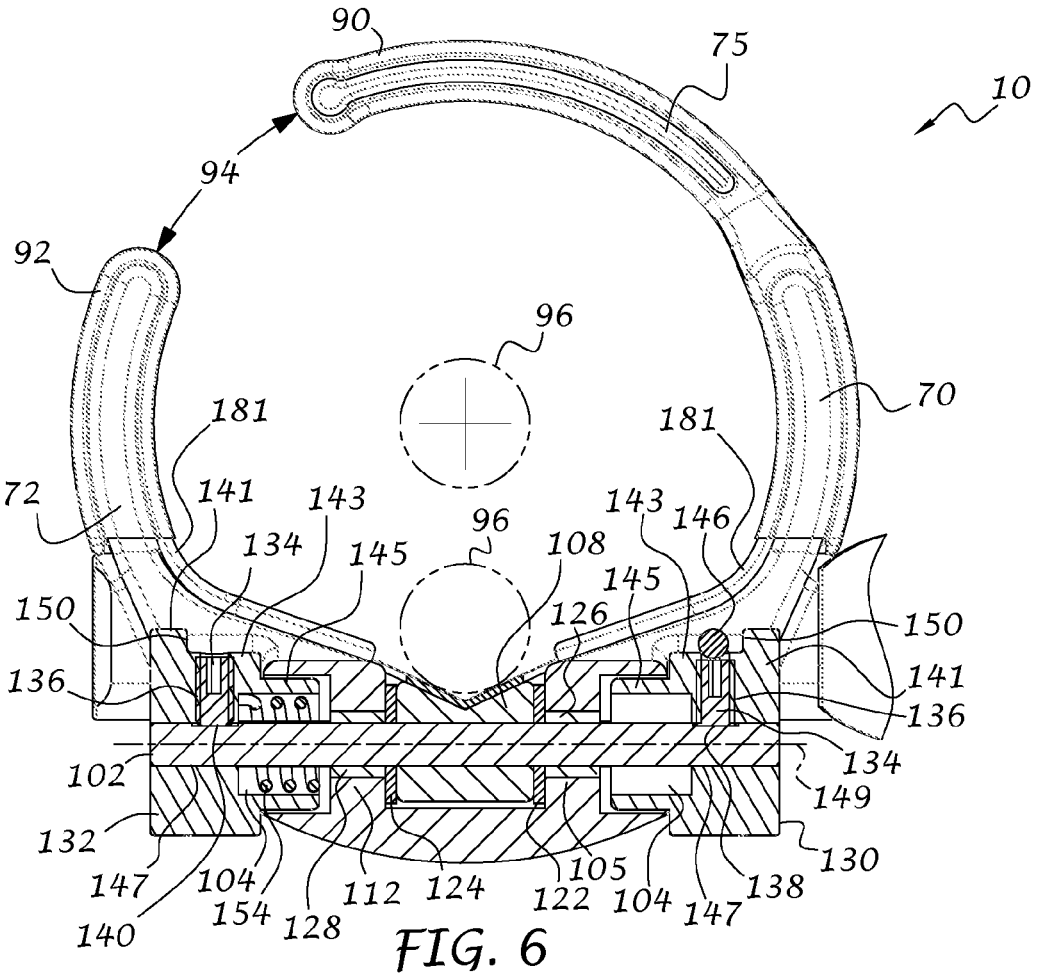
FIG. 6 is a sectional view of the resilient arrow rest assembly taken along line 6-6 of FIG. 5.

Referring now to FIGS. 4 and 6, the arrow rest 22 preferably includes a support body 66 with a floor portion 68 and arm portions 70 and 72 extending upwardly from the floor portion 68. The arm portions 70, 72 are similar in shape and each preferably has a bifurcated upper connection end 74 for receiving a capture arm 75. Depending on the left-hand or right-hand configuration, the capture arm 75 can be installed on either arm portion 70 or 72. Preferably, each upper connection end 74 includes a pair of spaced fingers 76, 77 with a gap 78 formed therebetween for receiving a lower connection end 80 of the capture arm 75. Threaded fasteners 82 preferably extend through apertures 84 of the finger 76, openings 88 in the connection end 80 of the capture arm 75, and threaded apertures 86 in the finger 77 to thereby connect the capture arm 75 to the support body 66. For a right-hand configuration, a first resilient sleeve 90 is received over the capture arm 75 and the fingers 76, 77 of the arm portion 70, while a second resilient sleeve 92 is received over the fingers 76, 77 of the arm portion 72. For a left-hand configuration, the capture arm 75 and resilient sleeves 90, 92 are reversed. The capture arm 75, arm portions 70, 72, and sleeves 90, 92 are preferably curved to thereby form a generally ring-shaped support body 66 with a gap 94 formed between the arm portions 70, 72. The gap 94 is configured to receive and capture the shaft 96 (FIGS. 2, 3 and 6) of an arrow, bolt, or the like. The support body 84 is preferably of unitary construction, and can be molded or machined from a single piece of material, such as reinforced plastic, metal, or the like. However, it will be understood that the support body 84 can be constructed of more than one part and connected together without departing from the spirit and scope of the invention. It will be further understood that the resilient sleeves 90, 92 can be eliminated or replaced with other sound and/or vibration dampening members without departing from the spirit and scope of the invention.

An arrow support portion 98 is rotatably connected to the floor portion 68 of the support body 66 via a torsion hinge assembly 100. The torsion hinge assembly preferably includes a shaft 102 that extends through a first bore 104 formed in a first upright tab 105 of the floor portion 68, a second bore 106 formed in the base 108 of the arrow support portion 98, and a third bore 110 formed in a second upright tab 112 of the floor portion. A space 114 between the first and second upright tabs is sized to receive the base 108 of the arrow support portion 98. A first or middle flat 116 is preferably formed at a mid section of the shaft 102 and threaded fasteners 118, such as set screws, engage threaded apertures 120 formed in the base 108 and press against the flat 116 so that the arrow support portion 98 is securely connected to the shaft 102 for rotation therewith. Bearing washers 122 and 124 are preferably positioned over the shaft 102 and are sandwiched between the first and second upright tabs 105, 112, respectively, and opposite sides of the base 108 of the arrow support portion 98. Bushings 126 and 128 are also preferably positioned over the shaft 102 and are sandwiched between their respective bearing washers 122 and 124 and pulleys 130 and 132. The pulleys 130, 132 are positioned at opposite ends of the shaft 102 and connected thereto via a threaded fastener 134, preferably in the form of a set screw, that engages a first threaded aperture 136 located in each pulley. The fasteners 134 press against respective second and third flats 138 and 140 formed at the ends of the shaft 102, so that the pulleys are securely connected to the shaft 102 for rotation therewith. The pulleys 130 and 132 are preferably identical to facilitate the change between right-hand and left-hand configurations.

As best shown in FIGS. 4 and 6-8, each pulley 130, 132 is preferably cylindrical in shape with a disk-shaped cover 141 (FIGS. 4 and 6), a first cylindrical protrusion 143 extending from the cover 141, and a second cylindrical protrusion 145 extending from the first protrusion 143. The cover 141, first protrusion 143 and second protrusion 145 are preferably integrally formed as a single unit through molding, machining, or other well-known manufacturing means. The second protrusion 145 of the pulley 130 is received in the first bore 104 of the floor portion 68. Likewise, the second protrusion 145 of the pulley 132 is received in the third bore 110 of the floor portion 68. A bore 147 preferably extends through the cover 141, the first protrusion 143, and the second protrusion 145 for receiving the shaft 102. The cover 141 preferably includes an offset portion 150 (FIG. 6) from a central axis 149 of the bore 147 for guiding movement of an actuating cable 146 during use of the arrow rest assembly 10, as will be described in greater detail below. Each pulley 130, 132 also preferably includes a second aperture 142 (FIG. 4) for receiving the first end 144 of the actuating cable 146. A third threaded aperture 148 (FIGS. 4 and 7) extends through the cover 141 and into the first protrusion 143 where it intersects the second aperture 142.

When the cable first end 144 is installed in the second aperture 142, a threaded fastener 152, preferably in the form of a set screw, is threaded into the third aperture 148 and presses against the actuating cable 146 to thereby securely hold the cable to the pulley 130 for a right-hand configuration. In a left-hand configuration, the actuating cable 146 is installed in the second aperture 142 of the pulley 132.

Figure 7:
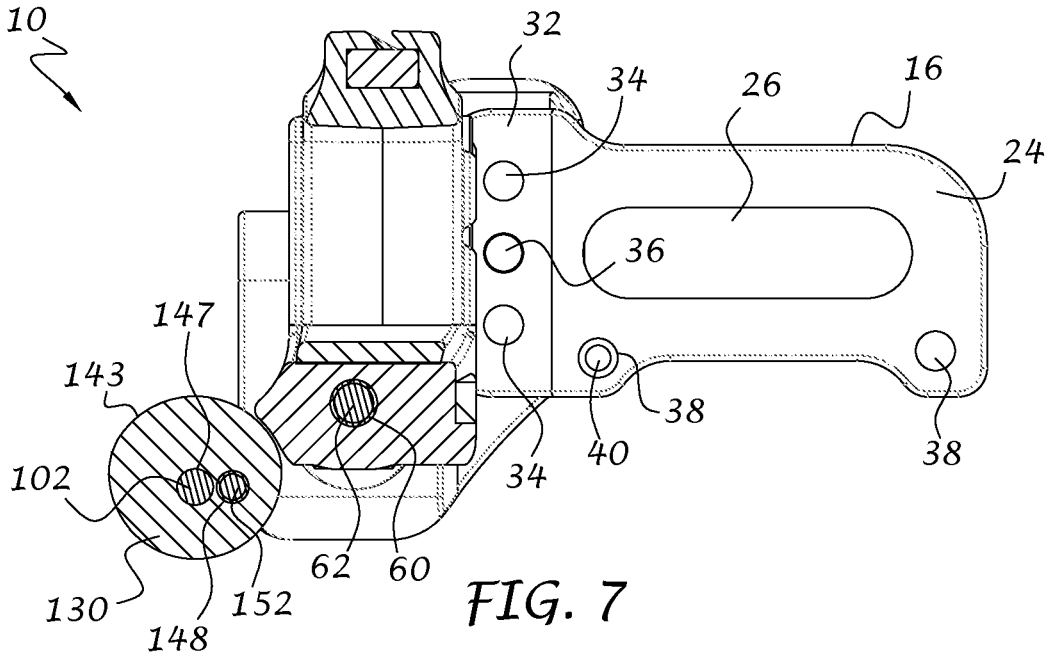
FIG. 7 is a sectional view of the resilient arrow rest assembly taken along line 7-7 of FIG. 5.
Figure 8:
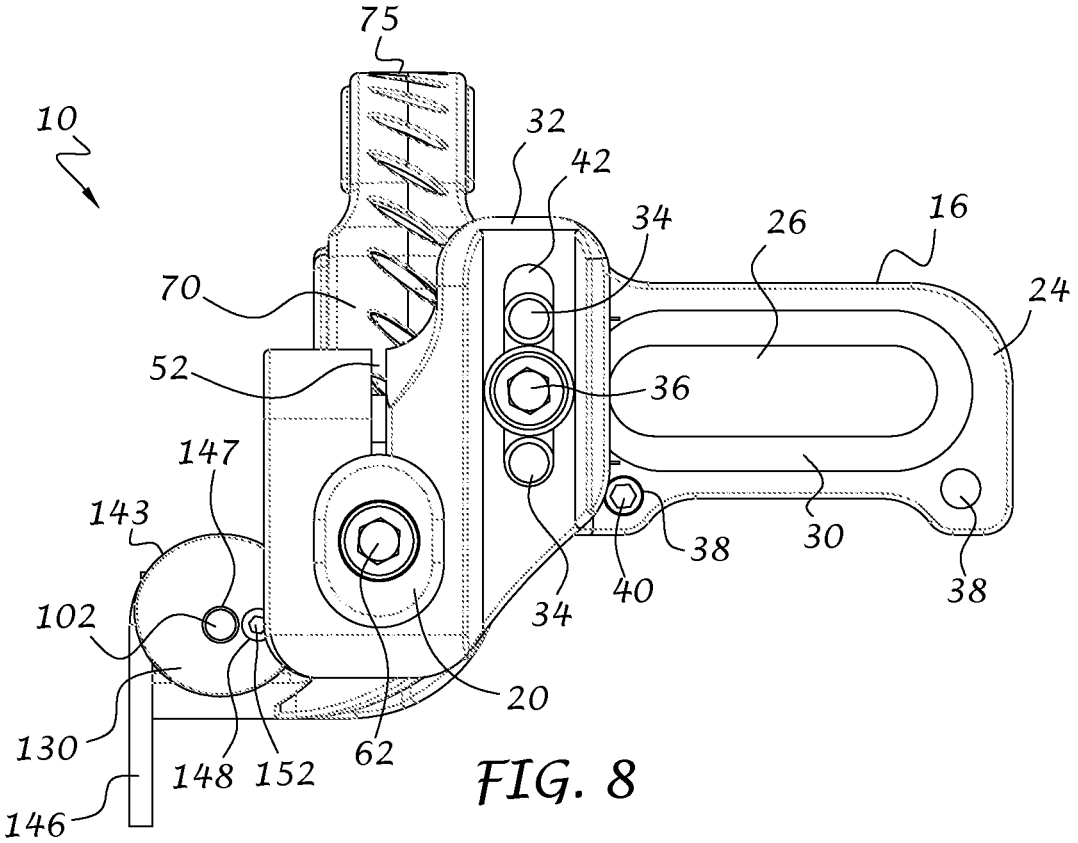
FIG. 8 is a right side elevational view of the arrow rest assembly.

A biasing member 154, in the form of a torsion spring, surrounds the shaft 102 and is preferably located within the pulley 132. A first leg (not labeled) of the torsion spring 154 is preferably captured within an aperture (not shown) located within the pulley 132 while a second leg (not labeled) of the torsion spring is captured within an aperture (not shown) of the second upright tab 112 such that rotation of the shaft 102 in the counter-clockwise direction, as viewed in FIGS. 7 and 8, is preferably met with torsional resistance. In this manner, the arrow support portion 98 is normally biased towards the lowered position (FIG. 2).

The second end 156 of the actuating cable 146 is preferably connected to a bus cable (not shown) of a compound bow or the like through a first clamping portion 158 (FIG. 4) and a second clamping portion 160 that are secured together by a threaded fastener 162 and nut 164 to thereby clamp both the actuating cable 146 and bus cable thereto in a well-known manner. In use, when the bowstring (not shown) is pulled toward an arrow launch position, the actuating cable 146 is also pulled rearwardly, causing the pulley 130, and thus the shaft 102 and arrow support portion 98, to rotate in a counter-clockwise direction against torsional bias from the spring 154 until the arrow support portion 98 is in the upright position, as shown in FIG. 3. During counter-clockwise rotation, the actuating cable is wound off of the second cylindrical protrusion with the guide ridge 150 ensuring that the cable will not travel off of the pulley 130 in a lateral direction. When the bowstring is released, the arrow support portion 98 returns to the lowered position (FIG. 2) and the actuating cable 146 is rewound on the second cylindrical protrusion 145. Again, the guide ridge 150 ensures that the cable will not travel off of the pulley 130 during the return movement. Since the actuating cable 146 rolls around the second protrusion instead of slid through an aperture as in prior art solutions, the actuating cable is no longer subjected to friction and consequent cable wear and breakage.

In accordance with a further embodiment of the invention, the arrow support portion 98 is preferably biased toward the upright position. This can be done by reversing the biasing member 154 on the shaft 102. The second end of the actuating cable 146 can then be connected to the upper limb (not shown) of the bow or other member so that the cable is taut when the bow is at rest and the cable is loose when the bow is drawn back. In this manner, when the cable is taught, the arrow support portion is in the lowered position. When the cable is loose, the arrow support portion is in the upright position.

Turning again to FIGS. 4 and 6, the arrow support portion 98 preferably includes a bifurcated portion 166 that extends from the base 108. The bifurcated portion is divided into a first wing 168 and a second wing 170 that converge toward the base 108 to form a first V-shaped channel 172 for receiving the shaft 96 (FIGS. 2 and 3) of an arrow when the arrow support portion 98 is in the upright (FIG. 3) position. A second V-shaped channel 174 is formed between the wings 168 and 170, preferably in an orientation that is perpendicular to the first V-shaped channel. The V-shaped configuration of the arrow support portion 98 in both the lowered and upright positions, as well as the V-shaped configuration of the floor portion 68, encourages the arrow shaft 96 to gravitate towards the center of the rest assembly when in both the lowered (FIG. 2) position and upright (FIG. 3) position of the arrow support portion 98.

The floor portion 68 of the support body 66 preferably has a V-shaped depression 176 located forwardly of the upright tabs 105, 112. A resilient vibration-absorbing pad 178 is preferably located in the depression and is also generally V-shaped in configuration. The pad 178 helps to reduce sound and vibration that might otherwise occur when the arrow support portion 98 is suddenly released from the upright position during arrow launch. The depression 176 is preferably sufficiently deep so that the arrow support portion 98 is flush with or below the upper surface of the floor portion 68 when in the lowered position. In this manner, the arrow shaft will not hang up on the arrow support portion during loading into the arrow rest assembly 10.

In order to further reduce noise and vibration during arrow launch, and as best shown in FIGS. 4 and 6, noise-reducing material, such as layer 183, can be attached to the arrow support portion 98. Other noise-reducing material, such as layer 181, can be connected to the floor portion 68 of the support body 66. The material can include, but is not limited to, bearing tape or other materials with a low coefficient of friction, felt or other non-woven materials, ceramic coatings, metallic or plastic bearing material, and so on.

As best shown in FIG. 4, a stop plate 182 is preferably connected to the first upright tab 105 and second upright tab 112 via screws 184 or other threaded fasteners. The stop plate 182 has a V-shaped notch 106 that is preferably flush with, or slightly lower than, the second V-shaped channel 174 of the arrow support portion 98 when in the lowered position. When the arrow support portion is rotated to the raised position, and in the event that the actuating cable 146 is not properly installed on the bus cable of the bow, there exists a possibility that the arrow support portion 98 may become over-extended during drawback of the bow. Accordingly, the stop plate 182 will stop the rotational travel of the arrow support portion 98 during drawback.

Referring now to FIGS. 9 and 10, the arrow rest assembly 10 is shown in a left-hand configuration. In accordance with one aspect of the invention, switching from the right-hand to left-hand configuration is facilitated by the identical pulleys 130, 132 and the switchable nature of the actuating cable 146 and capture arm 75.

In order to configure the arrow rest assembly from the right-hand to the left-hand configuration, and with further reference to FIG. 4, the connector arm 20 can be removed from the opening 50 by moving the arrow rest 22 to the left, as shown in FIG. 3. The connector arm 20 is removed from the support body 66, and flipped to the opposite side, then secured to the support body 66 with the fastener 62 threaded into the threaded aperture 65. If needed, the adjustment block 18 can also be flipped or otherwise adjusted to suit a particular bow configuration. The actuating cable 146 can then be removed by loosening the set screw 152 then pulling the cable out of the second aperture 142 of the pulley 130. The cable first end 144 can then be inserted into the second aperture 142 of the pulley 132 and secured by tightening the set screw 152 associated with the pulley 132. The capture arm 75 and resilient sleeve 90 are then removed from the arm portion 70 and the resilient sleeve 92 is removed from the arm portion 72. The capture arm 75 and resilient sleeve 90 are then installed on the arm portion 72 and the resilient sleeve 92 is installed on the arm portion 70, as previously described, so that the gap 94 is facing away from the riser 12 (FIG. 1) of the bow 14 to thereby facilitate arrow insertion into the arrow rest assembly 10. In this manner, switching between right- and left-handed shooting configurations is relatively quick and easy, does not require specialized parts for each configuration, and thus reduces costs associated with manufacturing, transportation, storage, and sales, since the components of the right-hand configuration are the same for the left-hand configuration.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute, orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An arrow rest for supporting the shaft of an arrow, the arrow rest being adaptable between right-hand and left-hand configurations and comprising:

a support body having a floor portion, a first arm portion and a second arm portion extending from the floor portion, the first and second arm portions having first and second upper connection ends, respectively;

an arrow support portion connected to the support body between the first and second arm portions for supporting the shaft of an arrow;

a gap formed between the first and second arm portions for receiving and capturing the shaft of an arrow; and a capture arm having a lower connection end for connection to one of the first and second upper connection ends;

wherein the capture arm is connected only to the first upper connection end of the first arm portion when the arrow rest is in a right-hand configuration, and the capture arm is connected only to the second upper connection end of the second arm portion when the arrow rest is in a left-hand configuration.

2. An arrow rest according to claim 1, wherein the first arm portion, second arm portion, and capture arm are curved to thereby form a generally ring-shaped support body with the gap formed between one of the first and second arm portions and the capture arm for receiving the shaft of an arrow.

3. An arrow rest according to claim 2, wherein each upper connection end comprises a bifurcated connection end with a first finger and a second spaced finger for receiving the lower connection end of the capture arm therebetween.

4. An arrow rest according to claim 3, and further comprising a first resilient sleeve positioned over the capture arm and one of the first and second arm portions.

5. An arrow rest according to claim 4, and further comprising a second resilient sleeve positioned over the other of the first and second arm portions.

6. An arrow rest according to claim 3, wherein the arrow support portion is rotatable between an upright position and a lowered position.

7. An arrow rest according to claim 6, and further comprising a hinge assembly connected to the support body and the arrow support portion, the hinge assembly comprising:

a shaft extending through the support body and the arrow support portion, the arrow support portion being fixed to the shaft for rotation therewith;

a first pulley connected to one end of the shaft for rotation therewith; and a second pulley connected to an opposite end of the shaft for rotation therewith;

wherein the first pulley is connected to an actuating cable when the arrow rest is in the right-hand configuration, and the second pulley is connected to the actuating cable when the arrow rest is in the left-hand configuration.

8. An arrow rest according to claim 7, wherein the hinge assembly further comprises a torsion spring connected to the shaft and the support body to thereby bias the arrow support portion toward one of the upright position and the lowered position.

9. An arrow rest according to claim 1, wherein the arrow support portion is rotatable between an upright position and a lowered position.

10. An arrow rest according to claim 9, and further comprising a hinge assembly connected to the support body and the arrow support portion, the hinge assembly comprising:

a shaft extending through the support body and the arrow support portion, the arrow support portion being fixed to the shaft for rotation therewith;

a first pulley connected to one end of the shaft for rotation therewith; and a second pulley connected to an opposite end of the shaft for rotation therewith;

wherein the first pulley is connected to an actuating cable when the arrow rest is in the right-hand configuration, and the second pulley is connected to the actuating cable when the arrow rest is in the left-hand configuration.

11. An arrow rest according to claim 10, wherein the hinge assembly further comprises a torsion spring connected to the shaft and the support body to thereby bias the arrow support portion toward the lowered position.

12. An arrow rest for supporting the shaft of an arrow, the arrow rest being adaptable between right-hand and left-hand configurations and comprising:

a support body;

an arrow support portion connected to the support body for supporting the shaft of an arrow;

a hinge assembly comprising:

a shaft extending through the support body and the arrow support portion, the arrow support portion being fixed to the shaft for rotation therewith between an upright position and a lowered position;

a first pulley connected to one end of the shaft for rotation therewith; and a second pulley connected to an opposite end of the shaft for rotation therewith;

an actuating cable having a first end connected to one of the first and second pulleys and a second end connectable to a bus cable of an archery bow;

wherein the actuating cable is connected to and at least partially wraps around the first pulley when the arrow rest is in a right-hand configuration, and the actuating cable is connected to and at least partially wraps around the second pulley when the arrow rest is in a left-hand configuration.

13. An arrow rest according to claim 12, wherein the hinge assembly further comprises a torsion spring connected to the shaft and the support body to thereby bias the arrow support portion from an upright position toward a lowered position.

14. An arrow rest according to claim 12, wherein the support body comprises:

a floor portion, a first arm portion and a second arm portion extending from the floor portion; and a capture arm being connected to either the first arm portion when the arrow rest is in the right-hand configuration, or the second arm portion when the arrow rest is in the left-hand configuration.

15. An arrow rest according to claim 14, and further comprising a first resilient sleeve positioned over the capture arm and one of the first and second arm portions.

16. An arrow rest according to claim 15, and further comprising a second resilient sleeve positioned over the other of the first and second arm portions.

17. An arrow rest according to claim 14, wherein the first arm portion, second arm portion, and capture arm are curved to thereby form a generally ring-shaped support body with a gap formed between one of the first and second arm portions and the capture arm for receiving the shaft of an arrow.

18. An arrow rest assembly for supporting the shaft of an arrow, the arrow rest assembly being adaptable between right-hand and left-hand configurations and comprising:

a mounting bracket adapted for connection to the riser of an archery bow;

an adjustment block connected to the mounting bracket, the adjustment block being adjustable in elevation with respect to the mounting bracket;

a connector arm connected to the adjustment block, the connector arm being adjustable in a windage direction with respect to the adjustment block, the connector arm being reversibly connectable to the adjustment block for adapting to the right-hand and left-hand configurations;

a support body having a floor portion, a first arm portion and a second arm portion extending from the floor portion, the first at second arm portions having first and second connection ends, respectively, each connection end including spaced first and second fingers;

a capture arm having a lower connection end for connection to one of the first and second connection ends between the first and second fingers, the capture arm being connected to the first arm portion when the arrow rest is in the right-hand configuration, and the capture arm being connected to the second arm portion when the arrow rest is in the left-hand configuration;

the first arm portion, second arm portion, and capture arm being curved to thereby form a generally ring-shaped support body with a gap formed between one of the first and second arm portions and the capture arm for receiving the shaft of an arrow;

an arrow support portion rotatably connected to the support body between the first and second arm portions for supporting the shaft of an arrow between an upright position and a lowered position;

a hinge assembly comprising:

a shaft extending through the support body and the arrow support portion, the arrow support portion being fixed to the shaft for rotation therewith between the upright position and the lowered position;

a first pulley connected to one end of the shaft for rotation therewith; and a second pulley connected to an opposite end of the shaft for rotation therewith;

an actuating cable having a first end connected to one of the first and second pulleys and a second end connectable to a bus cable of an archery bow;

wherein the actuating cable is connected to the first pulley and at least partially wraps therearound when the arrow rest is in a right-hand configuration, and the actuating cable is connected to the second pulley and at least partially wraps therearound when the arrow rest is in a left-hand configuration; and a torsion spring connected to the shaft and the support body to thereby bias the arrow support portion toward the lowered position.

19. An arrow rest assembly according to claim 18, and further comprising a first resilient sleeve positioned over the capture arm and one of the first and second arm portions.

20. An arrow rest assembly according to claim 19, and further comprising a second resilient sleeve positioned over the other of the first and second arm portions.

* * * * *